United States Patent [19]

Hall

[11] 4,190,251

[45] Feb. 26, 1980

[54] BUMP BOARD MARBLE GAME

[76] Inventor: Raymond M. Hall, 2339 E. 5th St., Dayton, Ohio 45403

[21] Appl. No.: 890,452

[22] Filed: Mar. 27, 1978

[51] Int. Cl.[2] ..... A63F 7/00; A63F 7/10

[52] U.S. Cl. ..... 273/124 R; 273/125 R

[58] Field of Search ..... 273/125 R, 125 A, 122 R, 273/110, 113, 124 R, 124 A

[56] References Cited

U.S. PATENT DOCUMENTS

| | | | |
|---|---|---|---|
| 884,605 | 4/1908 | McEvoy | 273/110 |
| 2,744,753 | 5/1956 | Beethoven | 273/125 R |
| 3,938,807 | 2/1976 | Luthi et al. | 273/110 |

FOREIGN PATENT DOCUMENTS

| | | | |
|---|---|---|---|
| 766473 | 4/1934 | France | 273/122 R |

*Primary Examiner*—George J. Marlo

*Attorney, Agent, or Firm*—W. Britton Moore

[57] ABSTRACT

A bump board game for finger propelled marbles including a walled enclosure having a flat sloping playing surface with spaced marble scoring holes therein and bump guide deflecting members arranged thereon. A dump board underlies the playing surface to retain marbles in the scoring holes and is hinged rearwardly with the front end being free and supported by a resilient pad so as to be depressible therewith to swing the board downwardly for releasing marbles from the scoring holes for return to the front of the enclosure.

9 Claims, 3 Drawing Figures

BUMP BOARD MARBLE GAME

This invention relates to a bump board game for finger propelled marbles including a fixed sloping playing surface and a dump board swingably arranged therebeneath for releasing marbles from the scoring holes upon the application of pressure thereto.

While many pocketed game boards have been proposed over which balls and marbles have been variously propelled, such as those, for example, shown in U.S. patents to Perry U.S. Pat. No. 602,358, Sterling U.S. Pat. No. 1,384,280, and Roberts U.S. Pat. No. 1,474,089, none of these prior art games have been intended for use in skillfully finger shooting marbles thereover and having simple depressible release means associated with the playing surfaces for releasing and returning the balls for further play.

The principal object of the present invention is to provide a walled enclosure having a flat sloping apertured playing surface with deflecting guide members arranged thereon whereby marbles may be finger propelled thereon and scoringly pocketed in the holes therein.

Another object is the provision of a fixed sloping playing surface with spaced marble scoring holes therein with a dump board underlying the playing surface for retaining the marbles in the holes thereof and being swingably supported relative thereto for downward swinging movement to release the marbles from the scoring holes for return to the front of the game.

Still another object is to provide a flat dump board hingedly attached at its rear end and having its forward end supported by a resilient pad for retaining marbles in the holes of the playing surface and depressible with the pad for swinging downward movement to release the marbles therefrom.

A further object is the provision of a walled enclosure having a glass covered top open at its front end with a flat forward sloping playing surface fixedly and spacedly mounted below the cover and having a V-shaped rearwardly extending deflecting member, a centrally extending deflecting member, and two rearwardly disposed corner deflecting guide rails associated with a series of spaced marble receiving scoring holes, with the playing surface being spaced from the side and front walls of the enclosure to enable those marbles finger projected thereover and not retained by the holes to be returned to the front of the enclosure for replay.

A still further object is to provide a fixed sloping playing surface with a cut-out in its front edge and wherein the dump board is coextensive therewith and the resilient pad is adjacent to and centrally disposed relative to the front edge of the board and the cut-out in the playing surface to facilitate depressing of the dump board for releasing the marbles.

These and other objects and advantages will be apparent as the specification is considered with the accompanying drawings, wherein FIG. 1 is a perspective view of a leg-supported bump board marble playing game;

Figure 1:
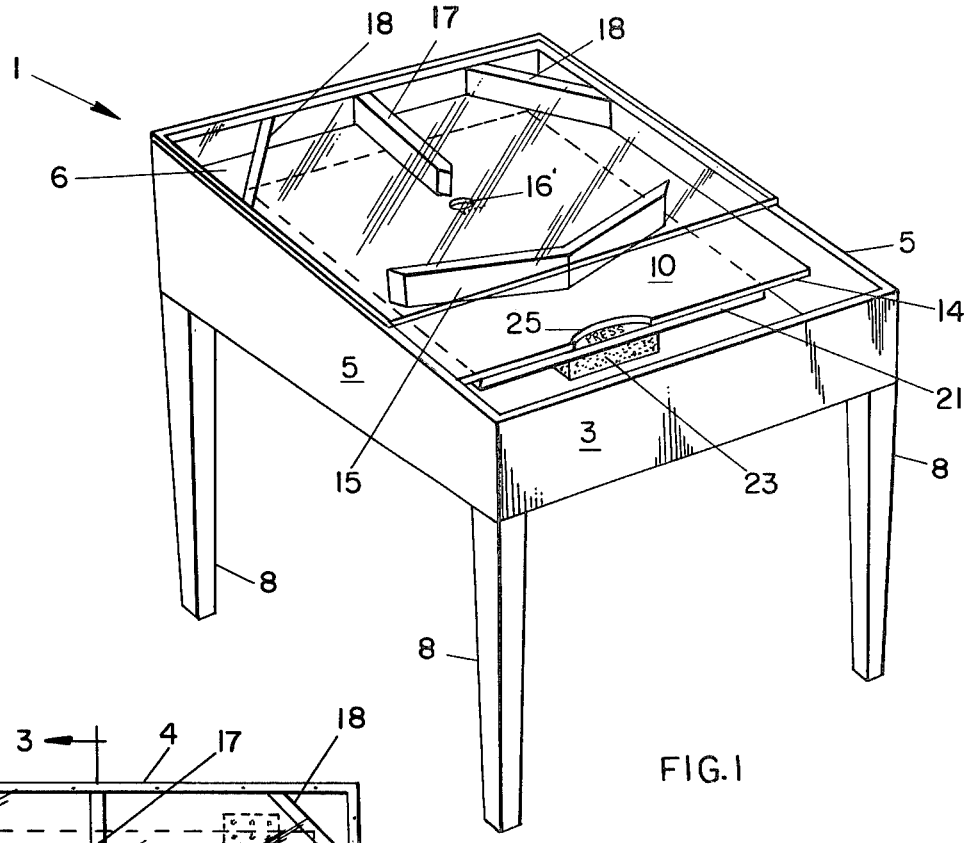

Referring more particularly to the drawings, wherein similar reference characters designate like parts throughout the several views, numeral 1 generally identifies a substantially rectangular game board enclosure including a floor 2 and upstanding front and rear walls 3–4, and side walls 5. A flat covering and viewing top 6, of some suitable transparent material, such as glass or plastic, is suitably mounted on and affixed to the rear and side walls and terminates short of and is spaced from front wall 3 to provide an opening 7 at the front of the enclosure for access thereto and playing therein. Four legs 8 are suitably attached to the corners of the enclosure to elevate it above a supporting surface. The rear wall 4 is slightly higher than front wall 3 and the side walls 5 increase in height from front to rear, and the floor 2 also slopes rearwardly and is affixed in a transverse groove 4' in the inner face of and spaced above the lower edge of the rear wall, for a purpose presently to be described. If desired, a cross strut 9 may be disposed beneath the floor and suitably connected to the side walls therebeneath to increase the rigidity thereof.

A flat generally rectangular playing game surface panel 10 is suitably fixedly secured at its rear to the underside of a transverse cross member 11, abutting rear wall 4, at its upper edge portion, and bridging and suitably attached to the upper edge portions of side walls 5, and at its side edges to the side walls. The panel is thus rigid and extends forwardly at a downward slant and terminates at a point spaced from the front wall 3 so as to provide a space 12 at the forward end of the enclosure to accommodate marbles 13, preferably ten or more.

Figure 2:
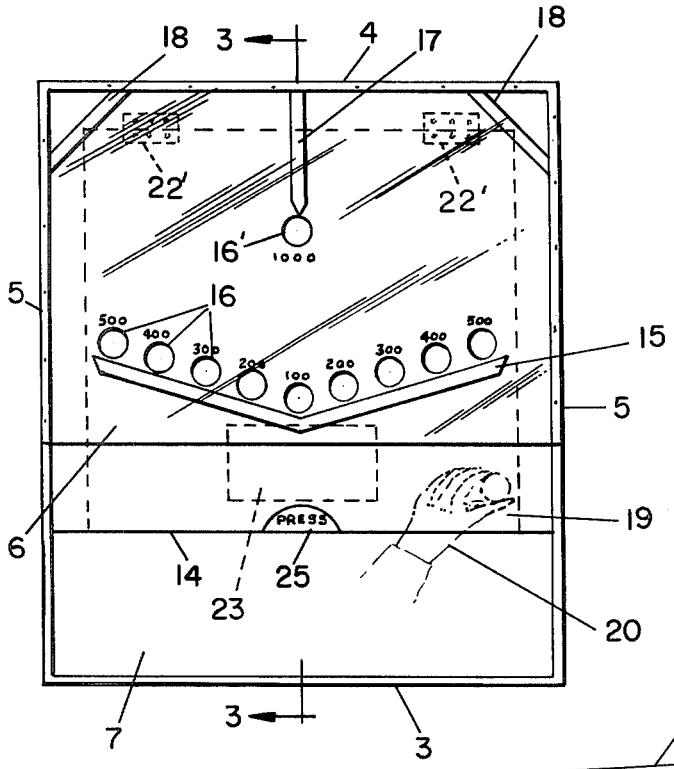
FIG. 2 is a plan view.
Figure 3:
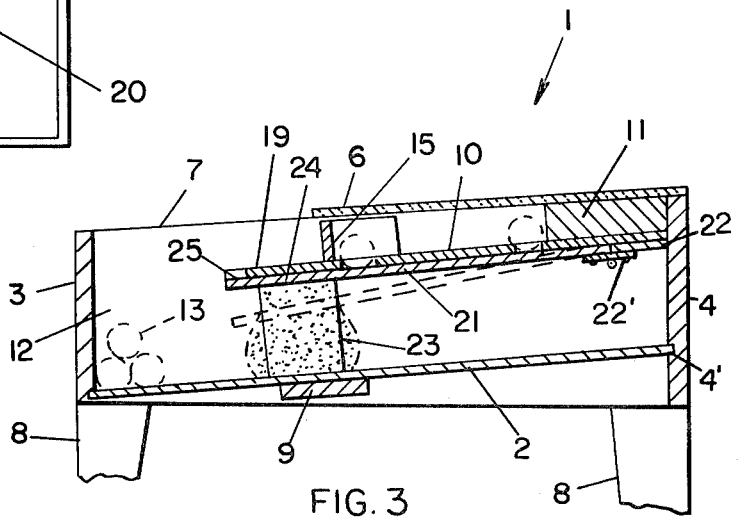
FIG. 3 is a section on the line 3—3 of FIG. 2.

Arranged on and suitably attached to the upper surface of panel 10, to the rear of and spaced from front edge 14, is a generally V-shaped angularly and rearwardly extending upstanding bump or deflecting member 15, the side edges of which are spaced from side walls 5 to provide spaces for marbles to be propelled therethrough. A row of spaced marble receiving and releasing holes 16 is arranged parallel to the rear faces of member 15 and may be suitably numerically inscribed, for example, from 100 to 500 for scoring purposes, as shown in FIG. 2. An elongated and forwardly pointed upstanding deflecting member 17 projects centrally from rear wall 4 and a marble receiving and releasing hole 16' inscribed 1000, for example, is arranged in the surface panel in front thereof. In addition, two angularly disposed upstanding bump rails 18 are arranged in the rear corners of panel 10 and serve to deflect marbles being propelled thereagainst, in an obvious manner. V-shaped member 15 is located below and is covered by the forward portion of glass top 6 and the forward portion of panel 10 projects forwardly thereof and is uncovered by top 6 to provide a supporting surface area 10 for a player's hand 20 when a marble 13 is grasped between the index finger and thumb thereof and propelled therefrom by thumb movement, in the customary marble playing manner. The marble will, of course, pass between either space between the side edges of V-shaped deflecting member 15 and the side walls 5 and either be caromed by a wall or corner rail 18 into the center area of panel 10 where it will lodge in one of the score holes 16,16' and indicate a score, or contact and be deflected by the rear faces of deflecting member 15.

In order to release those marbles received in and retained by any of holes 16,16', a dump board panel 21, generally rectangular in shape, is disposed beneath panel 10 so as to flatly engage the underside thereof. Dump panel 21 is coextensive in length with panel 10, but is narrower in width than and is spaced from the side walls 5, and rear edge portion 22 is suitably hinged, as at 22', to the underside of panel 10 so that the panel 21 may be depressed and swung downwardly, for a purpose hereinafter to be described. In lieu of being hinged, panel 21 may be of some suitable somewhat flexible material, in which event, it will be fixedly attached at its rear end to panel 10, and, thus, enable the forward portion thereof to be flexed downwardly. The forward portion of dump panel 21 rests upon and is supported by the flat upper face 24 of a generally rectangular pad 23 of some suitable resilient material, such as sponge, and the like, which is suitably affixed to floor 2 in line with the reinforcing cross strut member 9 thereof. A central arcuate cut-out or recess 25 in the front edge 14 of panel 10 enables finger pressure to be applied therethrough to panel 21 to force the latter squeezingly against pad 23 and depress and move the forward portion of the dump panel 21 away from contact with panel 10. Prior to being so depressed, panel 21 parallels and engages the underside of panel 10 so that the scoring holes 16,16′ therein are covered and any marbles lodged therein are retained thereby. Hence, depressing swinging movement against pad uncovers holes 16,16′ and permits the lodged marbles to drop therethrough and roll to the front of the enclosure against front wall 3 in the space 12 for replay and storage purposes.

From the foregoing, it will be apparent that marbles may be propelled upwardly over the sloping playing surface on either side of the V-shaped deflecting member and will be caromed into the center portion thereof by the side walls or corner rails. The maximum score may, of course, be obtained by a marble lodging in hole 16′, but the pointed end of deflecting member 17 increases the difficulty thereof. However, a marble missing this hole, still may enter holes 16 to the rear of the front deflecting member 15. Any marble missing deflecting member 15 will roll thereby and off the playing surface to be collected at the front of the enclosure for replay. Thus, considerable skill will be required in so shooting the marbles to obtain a good score.

While a preferred embodiment has been shown and described, it is to be understood that various changes and improvements may be made without departing from the scope and spirit of the appended claims.

What is claimed:

1. A bump board game for finger propelled marbles including a walled enclosure having a bottom, a flat forwardly sloping playing surface, spaced marble receiving scoring holes in said surface, dump board panel means arranged parallel beneath and engaging with said surface for retaining marbles lodged in said holes, means for pivotally connecting the rear of said panel means to the rear of said surface, and resilient compressible spring-like pad means arranged on the bottom of said enclosure beneath and to the rear of and for supporting the front of said panel means whereby manual downward pressure on the front upper surface of said panel means pivotally depresses said panel means relative to said playing surface to uncover said holes and release the marbles therein for rolling return over said panel means to the front of said enclosure.

2. A bump board game for finger propelled marbles, as defined in claim 1, wherein deflecting members are associated with said marble receiving scoring holes.

3. A bump board game for finger propelling marbles, as defined in claim 2, wherein one of said deflecting members is V-shaped and is at the front of said playing surface, and another thereof is elongated and pointed and centrally arranged at the rear of said surface.

4. A bump board game for finger propelled marbles, as defined in claim 3, wherein a row of spaced marble receiving holes is arranged in and parallel to said V-shaped deflecting member, and a single marble receiving hole is arranged adjacent to said pointed deflecting member.

5. A bump board game for finger propelled marbles, as defined in claim 1, wherein said panel means is hingedly connected at its rear to said surface and said panel is pivotal relative thereto.

6. A bump board game for finger propelled marbles, as defined in claim 5, wherein said pad means is centrally arranged relative to said panel means and is of sponge-like material.

7. A bump board game for finger propelled marbles, as defined in claim 6, wherein said pad means is affixed to said bottom and is formed with a flat upper surface for engaging the underside of said panel.

8. A bump board game for finger propelled marbles, as defined in claim 1, wherein said playing surface and said dump board means terminate short of the front of said enclosure to provide a front collecting area for the return and storage of said marbles, and transparent cover means covers said playing surface.

9. A bump board game for finger propelled marbles, as defined in claim 8, wherein said cover means terminates short of and is spaced rearwardly of the forward edges of said surface and dump board means to provide space to support a player's hand and enable marbles to be propelled over said playing surface.

* * * * *